US008471662B2

(12) United States Patent
Brendel et al.

(10) Patent No.: US 8,471,662 B2
(45) Date of Patent: Jun. 25, 2013

(54) OIL TRANSFORMER INSULATION MODULE

(75) Inventors: Hartmut Brendel, Halle (DE); Matthias Starke, Kabelsketal (DE)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 13/272,923

(22) Filed: Oct. 13, 2011

(65) Prior Publication Data

US 2012/0092113 A1 Apr. 19, 2012

(30) Foreign Application Priority Data

Oct. 15, 2010 (EP) ..... 10187707

(51) Int. Cl.
*H01F 27/02* (2006.01)
*H01F 27/08* (2006.01)
*H01F 27/10* (2006.01)

(52) U.S. Cl.
USPC ..... 336/94; 336/55; 336/57; 336/58

(58) Field of Classification Search
USPC ..... 336/55, 57, 58, 94
See application file for complete search history.

(56) References Cited

U.S. PATENT DOCUMENTS 2,710,947 A * 6/1955 Gaston ..... 336/60
2,844,746 A * 7/1958 Coggeshall ..... 310/65
3,071,845 A * 1/1963 Leonard et al. ..... 29/605
3,246,271 A * 4/1966 Ford ..... 336/94
3,302,149 A * 1/1967 Forsha ..... 336/58
3,386,060 A * 5/1968 Reber ..... 336/90
3,416,110 A * 12/1968 Morris et al. ..... 336/57
3,564,470 A * 2/1971 Van Nice ..... 336/60
3,585,276 A * 6/1971 Beckett ..... 174/138 E
3,713,061 A * 1/1973 Weber ..... 336/70
3,748,616 A * 7/1973 Weber et al. ..... 336/60
7,981,841 B2 * 7/2011 Kramer et al. ..... 505/150
2012/0092110 A1 4/2012 Brendel

* cited by examiner

*Primary Examiner* — Mohamad Musleh
*Assistant Examiner* — Joselito Baisa
(74) *Attorney, Agent, or Firm* — Buchanan Ingersoll & Rooney PC

(57) ABSTRACT

An oil transformer insulation module includes a plurality of disc-like insulation elements of identical type which are arranged flush one above another along a line, connected to one another and have in each case at least a similar outline contour. An insulation element includes a first flat layer and a second layer adjacent and predominantly parallel thereto. The first and second layers are composed of a mechanically strong, planar first insulation material. The first and second layers of the first insulation material are connected to and spaced apart from a third, corrugated layer arranged between the first and second layers and composed of a mechanically strong, planar second insulation material. The third layer has lateral edges and is corrugated in such a way that all the cavities formed by the corrugated form can be completely flooded with a liquid via the lateral edges of the insulation element.

21 Claims, 4 Drawing Sheets

OIL TRANSFORMER INSULATION MODULE

RELATED APPLICATION

This application claims priority under 35 U.S.C. §119 to European Patent Application No. 10187707.4 filed in Europe on Oct. 15, 2010, the entire content of which is hereby incorporated by reference in its entirety.

FIELD

The present disclosure relates to an oil transformer insulation module.

BACKGROUND INFORMATION

It is generally known that transformers having a rated power of, for example, 100 MVA or higher at a rated voltage of 110 kV or higher are usually embodied as oil transformers, which can have a weight of up to 200 t. In this case, the transformer is arranged within an oil-filled transformer tank, wherein the oil serves both for insulation and for improved cooling. The electrical connection of the respective terminals of the transformer to outgoing line insulators on the outer side of the oil tank is in this case effected by means of electrical conductors which, if appropriate, are surrounded by a barrier system. A barrier system is constructed radially symmetrically around the relevant conductor and includes an electrically conductive screening pipe and, as necessary, a plurality of insulation barriers spaced apart from one another.

For reasons of mechanical stability, the conductors or the pipe-like barrier systems should be supported at specific distances within the oil tank. For this purpose, use is made, as necessary, of supporting insulators produced, for example, from pressboard material. The insulation capability of a solid supporting insulator is generally lower than the insulation capability of pure oil given an identical insulation path owing to the additional loading by creepage paths.

It is therefore disadvantageous that a required insulation clearance in the region of a supporting insulator is higher than if the conductor and the barrier system were floating freely in the oil, such that the oil tank has to be made larger than absolutely necessary. In addition, oil transformers of relatively high power and voltage are unique articles or are manufactured only in very small series, thus also resulting in a wide variety of geometrical requirements made of the supporting insulators, which leads to an undesirable diversity of variants, which ultimately necessitates an increased production outlay.

SUMMARY

An exemplary embodiment of the present disclosure provides an oil transformer insulation module which includes a plurality of disc-like insulation elements of identical type which are arranged flush one above another along a line, connected to one another and each having a similar outline contour. At least one of the insulation elements has a first flat layer and a second layer adjacent and predominantly parallel thereto. The first and second layers are each composed of a mechanically strong, planar first insulation material. The first and second layers of the first insulation material are connected to and spaced apart from a third, corrugated layer which is arranged between the first and second layers and which is composed of a mechanically strong, planar second insulation material. The third layer has lateral edges and is corrugated such that all cavities formed by the corrugation of the third layer are configured to be completely flooded with a liquid via lateral edges of the at least one insulation element.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
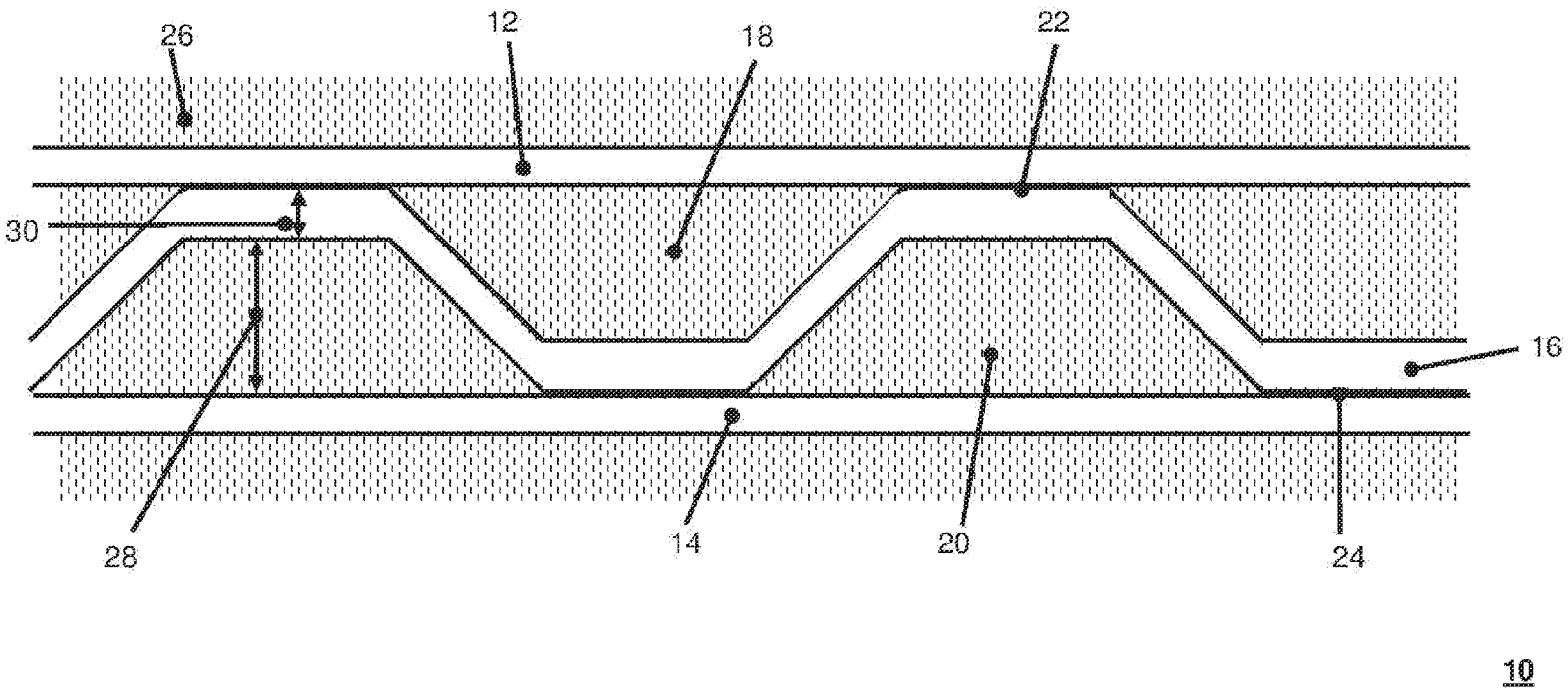
FIG. 1 shows a section through part of an oil-filled insulation element according to an exemplary embodiment of the present disclosure.

Exemplary embodiments of the present disclosure provide an oil transformer insulation module, as well as a supporting insulator for use in an oil-filled environment such as an oil tank, which have an improved insulation capacity and, moreover, can be manufactured simply in a high diversity of variants.

Exemplary embodiments of the present disclosure provide an oil transformer insulation module including a plurality of disc-like insulation elements of identical type which are arranged flush one above another along a line, connected to one another and each having at least a similar outline contour. The exemplary oil transformer insulation module provides that an insulation element has at least a first flat layer and a second layer adjacent and predominantly parallel thereto. The first and second layers are composed of a mechanically strong, planar first insulation material. The first and second layers of the first insulation material are connected to and spaced apart from a third, corrugated layer arranged which is arranged between the first and second layers and which is composed of a mechanically strong, planar second insulation material. The third layer has lateral edges and is corrugated in such a way that all the cavities formed by the corrugated form can be completely flooded with a liquid via the lateral edges.

Instead of using a solid supporting insulator, for example composed of pressboard or ceramic, the exemplary oil transformer module includes a supporting structure having cavities which are completely filled with oil during the operation of the transformer. The supporting structure can be manufactured, for example, from pressboard material. Each path along a surface normal determining the shortest breakdown path through an oil transformer insulation module formed in this way does not run exclusively in solid insulation material. Rather, as a result of the corrugated form of the third layer of the respective insulation elements, the cavities are configured in such a way that a part of the path always runs through oil as well. As a result of the different insulation capabilities of oil and solid insulation material such as pressboard in combination with their different dielectric constants, this results in an overall higher insulation capability of the entire arrangement.

The effect of the displacement of the electric field on account of the higher permittivity of a solid insulant such as pressboard into adjacent oil channels, which can exist, for example, between the barriers of the outgoing line to be supported, is drastically reduced as compared with solid constructions as a result of an oil proportion of the insulation path in the supporting insulator, in accordance with an exemplary embodiment of the present disclosure. In accordance with an exemplary embodiment, the oil proportion is in a range of 40% to 60%, for example, in the range of around 50%.

In accordance with an exemplary embodiment of the oil transformer insulation module according to the present disclosure, a path running purely through solid insulation material follows in sections the corrugated form of the third layer of each insulation element and is therefore oblique in sections and correspondingly longer relative to the shortest path along a surface normal, such that an improved insulation capability results in this regard as well.

In accordance with an exemplary embodiment of the oil transformer insulation module of the present disclosure, a prerequisite for an insulation capability during operation is, however, that the cavities of the oil transformer insulation module are completely flooded with oil and air inclusions are avoided. For this purpose, all the cavities should be configured such that they can be flooded at least from one side, for example, from two sides. It goes without saying that, instead of the tried and tested liquid insulant oil, it is also possible to use any other suitable liquid insulant. An oil transformer insulation module or an insulation element is flooded with oil through its open side edges into which the cavities produced by the corrugated third layer open as it were as channels. By establishing a vacuum, possible air inclusions can be removed particularly reliably even from horizontally arranged channels formed by cavities.

In order to ensure the mechanical stability of an oil transformer insulation module or of the insulation elements forming the latter at least in sections, exemplary embodiments of the present disclosure utilize a mechanically strong insulation material for the respective layers. For example, in the combination with the insulant oil, the insulation material pressboard or another appropriately hard material based on cellulose has proved to be worthwhile here. By contrast, a soft cellulose material such as paperboard, can be unsuitable. In the composite assembly of the first to third layers, a high mechanical stability of an oil transformer insulation module thus results, just as in the overall composite assembly of all insulation elements arranged one above another. According to an exemplary embodiment, an oil transformer insulation module is to be subjected to the highest stress with an electrical voltage along the line along which the insulation elements are arranged one above another.

The modular construction composed of a multiplicity of disc-like insulation elements of identical type which are arranged one above another and are connected to one another enables simple manufacture of different supporting insulator variants. Thus, in accordance with an exemplary embodiment, a relatively large panel of a three-layered composite material can be first manufactured, for example, having an edge length of 1 m by 1 m. Afterwards, the desired multiplicity of insulation elements can be cut out or sawn out in a desired outline form, for example, having an edge length of 15 cm by 15 cm. These insulation elements can then be arranged one above another, for example, by means of an adhesive connection. Consequently, an oil transformer insulation module or a supporting insulator having an improved insulation property is provided which can be manufactured particularly simply in a high diversity of variants.

In accordance with an exemplary embodiment of the oil transformer insulation module according to the present disclosure, the respective third layer of the insulation elements is corrugated in a trapezium-like manner at least in regions. This affords an improved possibility for planar connection of the plateaux of the third corrugated layer that are formed by the trapezium shape to the adjoining flat first and second layers, which additionally also has a positive effect on the insulation capability of the insulation element. Furthermore, the mechanical stability is advantageously increased by the now approximately straight strut form of the trapezium sides between respective first and third layers.

In accordance with an exemplary embodiment of the oil transformer insulation module according to the present disclosure, in the case of at least one insulation element, at least one further flat layer and one further corrugated layer connected thereto can be arranged between the first and second layers, thus resulting in an alternating sequence of flat and corrugated layers. This multilayered structure advantageously increases both the electrical insulation capability and the mechanical stability.

In accordance with an exemplary embodiment of the oil transformer insulation module according to the present disclosure, the first insulation material corresponds to the second insulation material, apart from the corrugated form. This simplifies the manufacture of an oil transformer insulation module. The differences in the insulation material could be based, for example, on the thickness thereof, for example 1 mm to 4 mm, or on the flexibility thereof, pressboard variants being a exemplary embodiment in each case.

In accordance with an exemplary embodiment of the oil transformer insulation module according to the present disclosure, the height of the cavities formed by the corrugated form of the third layer corresponds to at least double the thickness of the uncorrugated second insulation material, wherein a four- or six-fold thickness can perfectly well be suitable as well. This ensures that a minimum proportion of each insulation path running along a surface normal through the oil transformer insulation module runs through oil, as a result of which the insulation capability is advantageously increased.

In accordance with an exemplary embodiment of the oil transformer insulation module according to the present disclosure, the lateral edges of a corrugated layer are offset on all sides inwardly relative to the edges of the adjoining flat layers, such that a circumferential first groove is formed, by which, advantageously, the creepage path is lengthened and the insulation capability of the insulation element is increased.

In accordance with an exemplary embodiment of the oil transformer insulation module according to the present disclosure, an intermediate layer having a similar outline contour composed of a solid insulation material is arranged between at least two insulation elements arranged one above another. This can be expedient when, for example, only a relatively minor improvement in the insulation capability is required. In accordance with an exemplary embodiment, the intermediate layer has an outline contour which is larger than the respective outline contour of the adjoining insulation elements, such that the intermediate layer forms a circumferential overhang. The latter also lengthens the creepage path and thus improves the insulation capability. The same effect is also achieved by the intermediate layer having an outline contour that is smaller than the respective outline contour of the adjoining insulation modules, such that the intermediate layer forms a circumferential second groove directed inwardly.

A suitable adhesive for connecting adjacent layers of an insulation element, or for connecting insulation elements among one another or to an intermediate layer, is high-voltage-resistance adhesive such as casein, for example. The latter can dry under elevated pressure and under elevated temperature, in order to thus ensure a desired stable connection in the dried state.

In accordance with an exemplary embodiment, during operation of the oil transformer insulation module, all cavities formed by the corrugated form of the third layers of the insulation elements can be completely flooded with oil.

In accordance with an exemplary embodiment, an oil transformer insulation module or its insulation elements can achieve its desired insulation capability when all the cavities are filled with oil or some other suitable liquid insulant.

The present disclosure also provides an oil transformer including an oil tank and at least one oil transformer insulation module according to the exemplary embodiments of the present disclosure. Accordingly, the oil transformer can therefore be manufactured with a somewhat smaller oil tank in a particularly advantageous manner.

Further advantageous features of the present disclosure are described below with reference to exemplary embodiments illustrated in the drawings.

FIG. 1 shows a section 10 through a portion of an oil-filled insulation element according to an exemplary embodiment of the present disclosure. A first flat layer 12 composed of a first insulation material is connected to a third corrugated layer 16 of a second insulation material at a plurality of connection locations, one of which is designated by the reference symbol 22 by way of example. The other side of the third corrugated layer 16 is connected to a second flat layer 14 of the first insulation material at further connection locations 24, such that cavities 18, 20 are formed between the flat layers 12, 14 and the corrugated layer 16. In the exemplary embodiment of FIG. 1, the cavities 18, are indicated as being filled with oil 26. They are open at the lateral edges of the insulation element and have a channel-like form. This ensures that each channel can be flooded with a liquid insulation medium, in this example oil 26, via the lateral edges. Specifically, an insulation element has its full electrical insulation capability only when all the cavities are completely filled with a corresponding liquid insulation medium and air-filled regions are no longer present. For example, material variants of pressboard or some other stable cellulose material may be used as insulation materials, wherein the thickness of the respective first and second layer 12, 14 can be 2 mm to 5 mm, for example, and the thickness of the corrugated third layer can be 10 mm to 20 mm, for example, the latter value being composed of an actual material thickness 30 and a height 28 of a respective cavity 18, 20. In the state not filled with oil, this construction is particularly lightweight, such that a module of this type, in comparison with a solid insulator, can be handled particularly simply, for example, during mounting into an oil tank of an oil transformer to be manufactured.

A trapezium-like form of the corrugated layer 16 enables a planar contact-connection 22, 24 of the first 12 and second 14 layers to the third layer 16 at the thus flattened areas, which, in comparison with a sinusoidal form of corrugation, on account of the larger contact area, has a positive effect both on the mechanical stability of the insulation element and on the insulation capability thereof. Specifically, the oblique connecting web formed by the trapezium shape runs at a fixedly defined angle towards the first layer 12, rather than—as in the case of a sinusoidal form—at an arbitrarily acute angle, as a result of which the adjoining channel-like cavities 18, 20 in the connection location region would be fashioned correspondingly acutely and will be difficult to fill with oil, both of which adversely affect the insulation ability. The connection location 22, 24 can be realized, for example, using a suitable high-voltage-resistant adhesive such as casein.

Figure 2:
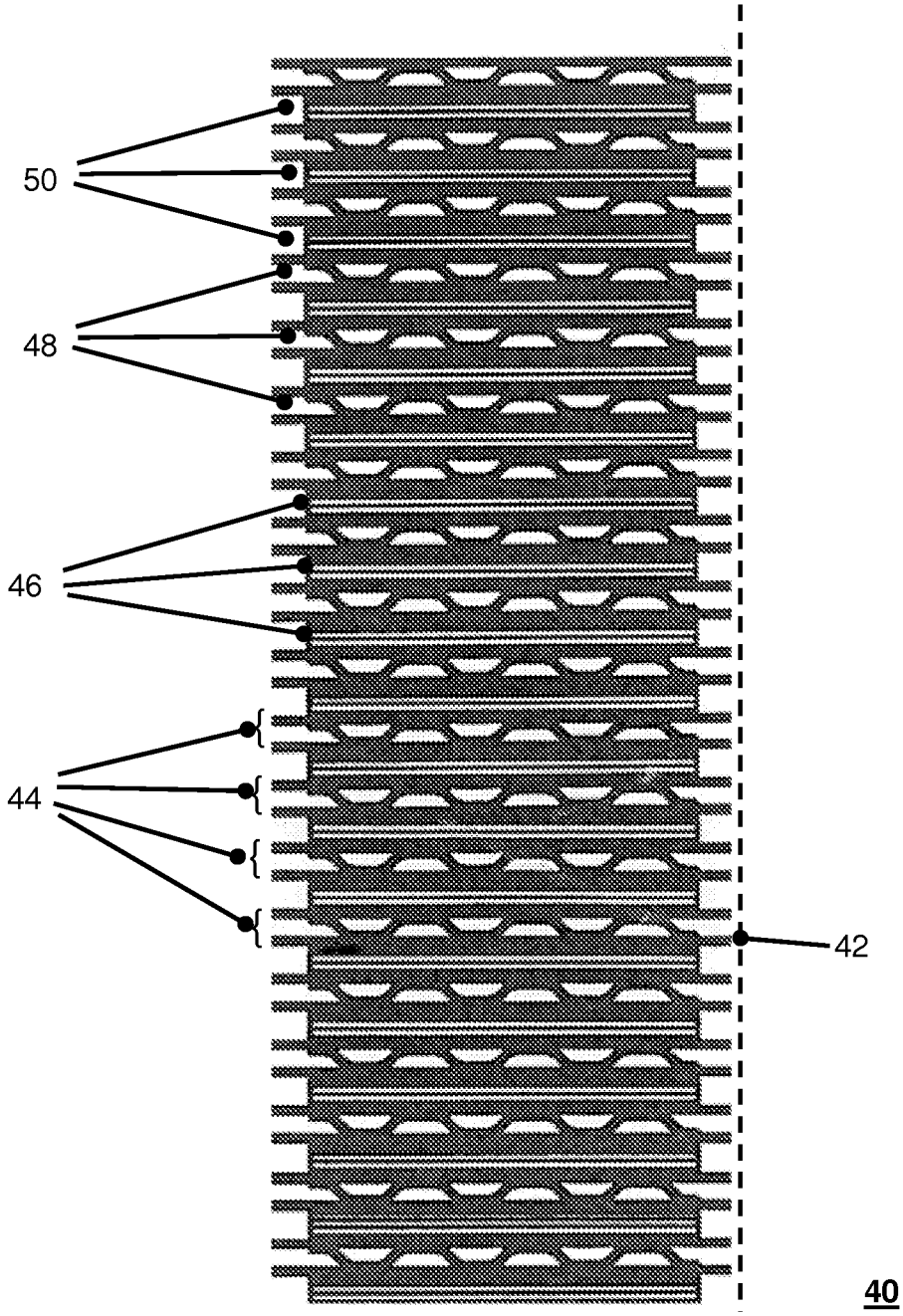
FIG. 2 shows a side view of an oil transformer insulation module according to an exemplary embodiment of the present disclosure.

FIG. 2 shows a side view 40 of an exemplary oil transformer insulation module including a plurality of insulation elements 44 of identical type, which are arranged one above another flush along a line 42. A first intermediate layer 46 composed of a solid insulation material is respectively arranged between two axially adjacent insulation elements 44. The first intermediate layer, in each case, has a thickness similar to that of the insulation elements, for example, 1 cm or 2 cm. The connection between insulation elements 44 and the intermediate layers 46 is effected by means of a cured high-voltage-resistant adhesive. A pressboard variant is also appropriate for the material of the intermediate layers 46.

The intermediate layers 46 have a smaller outline contour than the outline contour of the respective insulation elements 44, such that a circumferential second groove 50 oriented transversely with respect to the line 42 is fashioned in each case. In accordance with an exemplary embodiment, the second groove 50 advantageously lengthens the creepage path along the line 42. As a result of the respective corrugated layers of the insulation elements being set back relative to the adjoining first and second layers thereof, by which the outline contour of an insulation element is determined, a first circumferential groove 48 is respectively formed, which again lengthens the creepage path. An intermediate layer 46 can, for its part, also be formed from a plurality of interconnected flat layers of one or else different insulants, as indicated in the drawing.

Figure 3:
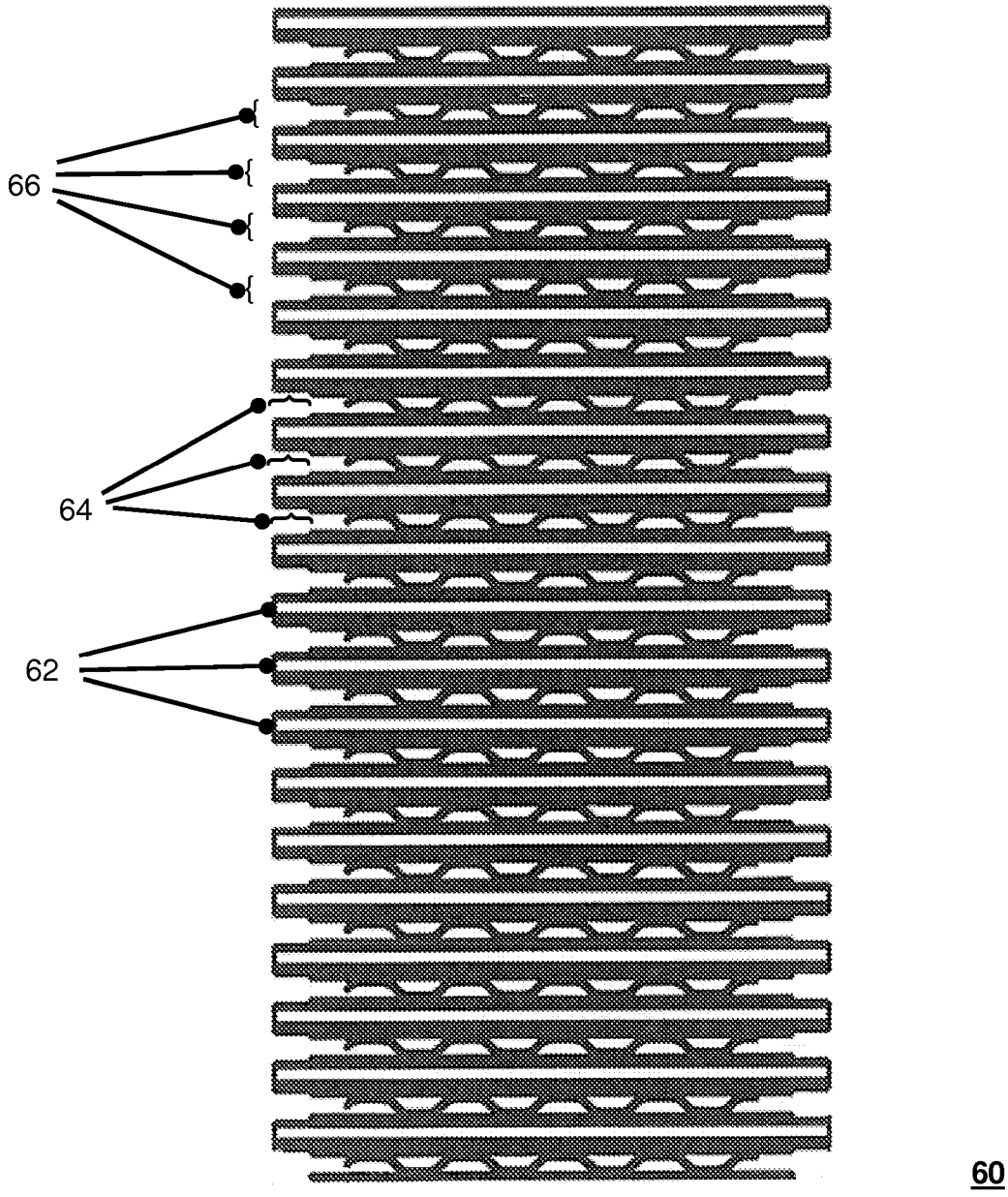
FIG. 3 shows a side view of an oil transformer insulation module according to an exemplary embodiment of the present disclosure.

FIG. 3 shows a side view 60 of an exemplary oil transformer insulation module. The oil transformer insulation module illustrated in FIG. 3 substantially corresponds to the oil transformer insulation module shown in FIG. 2, that is to say, the oil transformer insulation module illustrated in FIG. 3 has insulation elements 66 arranged one above another and intermediate layers 62 arranged therebetween. However, in the exemplary embodiment illustrated in FIG. 3, the respective intermediate layers 62 have a larger outline contour than the insulation elements 66, such that a circumferential overhang 64 is respectively formed, by which the creepage path is likewise advantageously lengthened. A further creepage path lengthening by means of first grooves formed as a result of the respective corrugated layers being respectively set back is likewise realized in the oil transformer insulation module shown, but not provided with corresponding reference symbols.

Figure 4:
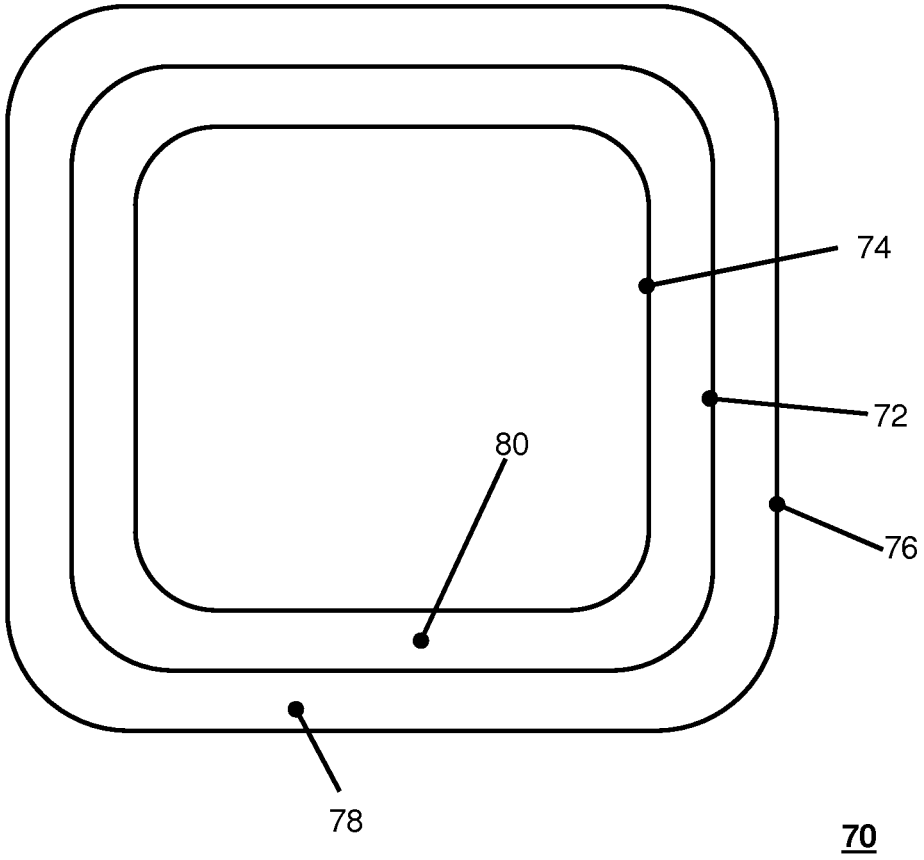
FIG. 4 shows a plan view of various outline contours according to an exemplary embodiment of the present disclosure.

FIG. 4 shows an exemplary plan view of various outline contours of an oil transformer insulation module corresponding to the side view in FIG. 3. The outline contours are in each case similar in respect of the form, but have different cross sections. Reference numeral 72 shows an outline contour of an exemplary insulation element, for example, having an edge length of 12 cm by 12 cm. This in turn is determined by the outline contour of the first and third layers of the insulation element. The outline contour of the corrugated layer which is enclosed by the two flat layers of an insulation element and is set back inwardly is indicated by reference numeral 74. The circumferential first groove resulting from the setting-back is indicated by reference numeral 80. Reference numeral 76 correspondingly shows the outline contour of an intermediate layer 76 having an overhang 78 that likewise lengthens the creepage path.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

List of Reference Symbols

10 Section through part of an oil-filled insulation element
12 First flat layer
14 Second flat layer
16 Third corrugated layer
18 First cavity
20 Second cavity
22 First connection location
24 Second connection location
26 Oil
28 Height of a cavity
30 Thickness of the second insulation material
40 Side view of first exemplary oil transformer insulation module
42 Line
44 Disc-like insulation element of identical type
46 First intermediate layer
48 Circumferential first groove
50 Circumferential second groove
60 Side view of second exemplary oil transformer insulation module
62 Second intermediate layer
64 Circumferential overhang
66 Disc-like insulation element of identical type
70 Plan view of various outline contours
72 Outline contour of an insulation element
74 Outline contour of corrugated layer offset inwardly on all sides
76 Outline contour of intermediate layer with circumferential overhang
78 Circumferential overhang
80 Circumferential first groove

What is claimed is:

1. An oil transformer insulation module comprising:

a plurality of disc-like insulation elements of identical type which are arranged flush one above another along a line, connected to one another and each having a similar outline contour; and an intermediate layer having a similar outline contour composed of a solid insulation material arranged between at least two insulation elements arranged one above another, wherein at least one of the insulation elements has a first flat layer and a second layer adjacent and predominantly parallel thereto, the first and second layers each being composed of a mechanically strong, planar first insulation material, wherein the first and second layers of the first insulation material are connected to and spaced apart from a third, corrugated layer which is arranged between the first and second layers and which is composed of a mechanically strong, planar second insulation material, wherein the third layer has lateral edges and is corrugated such that all cavities formed by the corrugation of the third layer are configured to be completely flooded with a liquid via lateral edges of the at least one insulation element, and wherein the intermediate layer has an outline contour which is larger than the respective outline contour of the adjoining insulation elements, such that the intermediate layer forms a circumferential overhang.

2. The oil transformer insulation module according to claim 1, wherein the third layer is corrugated in a trapezium-like manner at least in regions of the third layer.

3. The oil transformer insulation module according to claim 1, comprising:

at least one further flat layer and one further corrugated layer connected thereto, the at least one further flat layer and the further corrugated layer being arranged between the first and second layers to form an alternating sequence of flat and corrugated layers.

4. The oil transformer insulation module according to claim 1, wherein the first insulation material corresponds to the second insulation material.

5. The oil transformer insulation module according to claim 1, wherein a height of the cavities formed by the corrugation of the third layer corresponds to at least double a thickness of an uncorrugated portion of the second insulation material.

6. The oil transformer insulation module according to claim 1, wherein lateral edges of the corrugated third layer are offset on all sides inwardly relative to edges of the adjoining flat layers, such that a circumferential first groove is formed.

7. The oil transformer insulation module according to claim 1, wherein adjacent layers are connected to one another by means of a high-voltage-resistant adhesive.

8. The oil transformer insulation module according to claim 1, wherein all the cavities formed by the corrugation of the third layer are completely flooded with oil.

9. An oil transformer comprising:

an oil tank; and at least one oil transformer insulation module according to claim 1.

10. The oil transformer insulation module according to claim 1, wherein the second layer is substantially flat.

11. The oil transformer insulation module according to claim 1, wherein the intermediate layer is formed by a plurality of interconnected flat layers.

12. An oil transformer insulation module comprising:

a plurality of disc-like insulation elements of identical type which are arranged flush one above another along a line, connected to one another and each having a similar outline contour; and an intermediate layer having a similar outline contour composed of a solid insulation material arranged between at least two insulation elements arranged one above another, wherein at least one of the insulation elements has a first flat layer and a second layer adjacent and predominantly parallel thereto, the first and second layers each being composed of a mechanically strong, planar first insulation material, wherein the first and second layers of the first insulation material are connected to and spaced apart from a third, corrugated layer which is arranged between the first and second layers and which is composed of a mechanically strong, planar second insulation material, wherein the third layer has lateral edges and is corrugated such that all cavities formed by the corrugation of the third layer are configured to be completely flooded with a liquid via lateral edges of the at least one insulation element, and wherein the intermediate layer has an outline contour that is smaller than the respective outline contour of the adjoining insulation module, such that the intermediate layer forms a circumferential second groove.

13. The oil transformer insulation module according to claim 12, comprising:

at least one further flat layer and one further corrugated layer connected thereto, the at least one further flat layer and the further corrugated layer being arranged between the first and second layers to form an alternating sequence of flat and corrugated layers.

14. The oil transformer insulation module according to claim 12, wherein the first insulation material corresponds to the second insulation material.

15. The oil transformer insulation module according to claim 12, wherein a height of the cavities formed by the corrugation of the third layer corresponds to at least double a thickness of an uncorrugated portion of the second insulation material.

16. The oil transformer insulation module according to claim 12, wherein lateral edges of the corrugated third layer are offset on all sides inwardly relative to edges of the adjoining flat layers, such that a circumferential first groove is formed.

17. The oil transformer insulation module according to claim 12, wherein adjacent layers are connected to one another by means of a high-voltage-resistant adhesive.

18. The oil transformer insulation module according to claim 12, wherein all the cavities formed by the corrugation of the third layer are completely flooded with oil.

19. An oil transformer comprising:

an oil tank; and at least one oil transformer insulation module according to claim 12.

20. The oil transformer insulation module according to claim 12, wherein the intermediate layer is formed by a plurality of interconnected flat layers.

21. The oil transformer insulation module according to claim 12, wherein the second layer is substantially flat.

* * * * *